US005595543A

United States Patent [19]

Wolk

[11] Patent Number: 5,595,543

[45] Date of Patent: Jan. 21, 1997

[54] GOLF PUTTING PRACTICE SYSTEM

[76] Inventor: Roger S. Wolk, 28 Malibu Colony, Malibu, Calif. 90265

[21] Appl. No.: 549,126

[22] Filed: Oct. 27, 1995

[51] Int. Cl.[6] ..... A63B 69/36; A63B 67/02

[52] U.S. Cl. ..... 473/162; 473/163; 473/184; 473/236; 473/265

[58] Field of Search ..... 473/163, 162, 473/184, 236, 265

[56] References Cited

U.S. PATENT DOCUMENTS

| | | | |
|---|---|---|---|
| 2,456,813 | 12/1948 | Cavins | 473/184 X |
| 3,194,564 | 7/1965 | Swan | 473/236 |
| 3,572,720 | 3/1971 | Berg | 473/265 X |
| 3,831,949 | 8/1974 | Henning | 473/162 X |
| 4,323,246 | 4/1982 | Nehrbas, Jr. . | |
| 4,437,669 | 3/1984 | Pelz . | |
| 4,453,717 | 6/1984 | Solheim et al. | 473/265 |
| 5,011,153 | 4/1991 | Watkins | 473/236 |
| 5,082,280 | 1/1992 | Wang . | |
| 5,135,229 | 8/1992 | Archer . | |
| 5,150,904 | 9/1992 | Sindelar . | |
| 5,246,233 | 9/1993 | Sheltman et al. . | |
| 5,478,078 | 12/1995 | Lee | 473/236 |

*Primary Examiner*—George J. Marlo
*Attorney, Agent, or Firm*—Thomas I. Rozsa; Tony D. Chen

[57] ABSTRACT

A golf putting practice system which is a complete golf putting system to train a golfer in the fine points in putting a golf ball. The putting practice system comprises an elongated putting track and a training device. The putting track is used to simulate a true golf course turf for putting the golf ball. The training device is provided for line of sight for the golfer. The elongated putting track is made from three pieces which comprises a front uphill ramp including a width adjustable channel, a middle uphill ramp and a rear uphill ramp including a cooperating ball return gutter and cup hole. The training device comprises two L-shaped attachment deflection members with two adjustable guide pointers, removably attached to a face of a conventional golf putter.

24 Claims, 4 Drawing Sheets

GOLF PUTTING PRACTICE SYSTEM

BACKGROUND OF THE INVENTION

1. Field of the Invention

The present invention relates to the field of golf accessories. More particularly, the present invention relates to the field of golf training systems which include a special putting track for training a user to properly putt a golf ball.

2. Description of the Prior Art

Generally, there are many golf training devices which have been developed over the years for improving a golfer's putting game. One of the prior art devices is a putting track for practicing a putting stroke by rolling a golf ball along an upwardly sloping surface of the track. The disadvantage with this prior art putting track is that it only has a very short sloping track, and most of the putting is performed on a flat carpet which rests on the user's floor.

Another prior art device is a golf putter which has two tees installed within two recesses on the putter. The two tees are used as alignment markers or pointers when they are placed on the golf, putter to facilitate striking of the golf ball on a true line towards the cup hole. The disadvantage with this device is that the recesses on the golf putter are at a fixed position and the tees cannot be adjusted in the transverse plane. These alignment markers are designed to be slightly greater than the diameter of the golf ball and by doing this, the golfer who is practicing his or her putting stroke is forced into a position where he or she has to hit the golf ball exactly between the two alignment markers, e.g., the "sweet spot" portion of the golf putter. When the golf ball is incorrectly stroked, it strikes one of the alignment markers and is deflected away from the target.

The following six (6) prior art patents were uncovered in the pertinent field of the present invention.

1. U.S. Pat. No. 4,323,246 issued to Nehrbas, Jr. on Apr. 6, 1982 for "Golf Practice Putting Aid" (hereafter "the Nehrbas Patent");

2. U.S. Pat. No. 4,437,669 issued to Pelz on Mar. 20, 1984 for "Golf Practice Putting Track" (hereafter "the Pelz Patent");

3. U.S. Pat. No. 5,082,280 issued to Wang on Jan. 21, 1992 for "Putting Practice Device" (hereafter "the Wang Patent");

4. U.S. Pat. No. 5,135,229 issued to Archer on Aug. 4, 1992 for "Golf Putter With Training Device" (hereafter "the Archer Patent");

5. U.S. Pat. No. 5,150,904 issued to Sindelar on Sep. 29, 1992 for "Golf Putting Training Device" (hereafter "the Sindelar Patent"); and 6. U.S. Pat. No. 5,246,233 issued to Sheltman et al. on Sep. 21, 1993 for "Device For Putting Training" (hereafter "the Sheltman Patent").

The Nehrbas Patent discloses a golf practice putting aid. It includes a pressure sensitive adhesive backing for removably attaching the aid to the striking face of a conventional putter. The golf putting aid has a transversely extending backing member with front and rear surfaces. A pair of upright spaced parallel rails extend outward from the front surface at the transverse limits of the backing member.

The Pelz Patent discloses a golf putting stroke practice track contoured to follow the putter head path during a putting stroke. The practice track includes a pair of L-shaped rail sections which are curved or contoured so that their lowest portion is located at or near the point of impact and so that they are gradually raised towards either end from the impact point.

The Wang Patent discloses a golf putting practice device. It includes a sloping board, a slope-adjusting plate, a surface mat and an access plate. An arcuate sloping tunnel transversely formed in the sloping board communicates with a ball hole which arcuately slopes sidewardly and downwardly on the sloping board.

The Archer Patent discloses a golf putter head. It includes a pair of notches which are formed in the top surface of the face plate thereof. These notches receive golf tees in removable retention such that when installed in place on the club head, they form spacers. The distance between the spacers is slightly larger than the diameter of a golf ball such that the ball can fit therebetween and without permitting the ball to strike either tee, thereby perfecting the ability to strike the ball at the optimum point on the face plate.

The Sindelar Patent discloses a golf putting training device. It includes a golf club head with a stabilizer portion which is provided at its heel end and is used in combination with a planar guide surface to practice putting strokes.

The Sheltman Patent discloses an apparatus for training a person to putt a golf ball accurately. It includes a pair of guide rails and a fixing means for removably fixing the rail on a soft surface. A connecting rod has an elongated slot extending linearly over the length of the rod, has an arcuate segment at one end, and includes a series of spaced apart alignment marks. The slot slidably accepts an attaching means of one rail for rotatably and slidably mounting the rail in the slot. A pivotal mounting hole rotatably accepts a sliding attaching means of one guide rail so that the other of the rails may be rotated with respect to the connecting rod.

It is highly desirable to have a very efficient and also very effective design and construction of a golf putting practice system for teaching a user to properly putt a golf ball. It is desirable to provide a golf putting practice system with an elongated putting track for putting the golf ball on a simulated golf course turf. It is also desirable to provide a golf putting practice system with a training device for providing line of sight to the golfer.

SUMMARY OF THE INVENTION

The present invention is a golf putting practice system which is a complete golf putting system to enable a golfer to practice the mechanical technique of putting a golf ball. The putting practice system comprises an elongated putting track and a deterrent training device. The putting track is used to simulate a real golf course turf for putting the golf ball. The training device is used to provide a line of sight for the golfer. The putting track may be made from one, two or three pieces. Preferably, the putting track is made from a three piece design which comprises a front uphill ramp, a middle uphill ramp and a rear uphill ramp. The training device comprises two attachment deflection members with two adjustable guide pointers, in which the attachment deflection members are removably attachable to a face plate of a conventional golf putter.

It is therefore an object of the present invention to provide a golf putting practice system which comprises a complete golf training system for properly teaching a user the mechanical points in putting a golf ball.

It is also an object of the present invention to provide a golf putting practice system which comprises an elongated adjustable putting track having a plurality of uphill ramps attached together so that the track can be adjusted in different lengths, where the user can experience different putting lengths and putt the golf ball on a real simulated golf course turf.

It is an additional object of the present invention to provide a plurality of uphill ramps so that the ramps can be easily assembled into an elongated putting track or disassembled into shorter and smaller components for storage.

It is a further object of the present invention to provide a golf putting practice system which comprises a deterrent training device for providing a line of sight for the golfer, in which the training device can be readily installed on a conventional golf putter to teach the golfer to stroke the putter correctly without rotating his or her wrists, where the deterrent training device can be removed from the putter during actual play.

It is an additional object of the present invention to provide a deterrent training device comprising attachment deflection members, where the attachment deflection members are attachable to a face plate of a conventional golf putter and define a sweet spot portion therebetween on the golf putter so that when the user correctly swings the golf putter, the golf ball will strike the sweet spot on the putter and the golf ball will not be deflected away from the target line toward the cup hole; and when the user incorrectly swings the putter, and thereby causes the golf ball to strike one of the attachment deflection members, it causes the golf ball to be deflected away from the target line.

It is a further object of the present invention to provide attachment deflection members with guide pointers so that a golfer will see during the stroke when his or her wrists are rotating because the guide pointers provide a visual aid for the golfer.

It is another object of the present invention to provide a putting track which comprises two opposite parallel rails, where the width between the two opposite rails can be increased or decreased by adjustable and removable training curbs which vary the difficulty of a putting stroke.

In the preferred embodiment of the present invention, the golf putting practice system comprises an elongated putting track for putting the golf ball on a real simulated golf course turf and a deterrent training device for providing line of sight for the golfer, where the putting track is a three piece construction.

In an alternative embodiment of the present invention, the golf putting practice system comprises an elongated putting track and a deterrent training device, where the putting track is a two piece construction.

In another alternative embodiment of the present invention, the golf putting practice system comprises an elongated putting track and a deterrent training device, where the putting track is of a unitary continuous construction.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
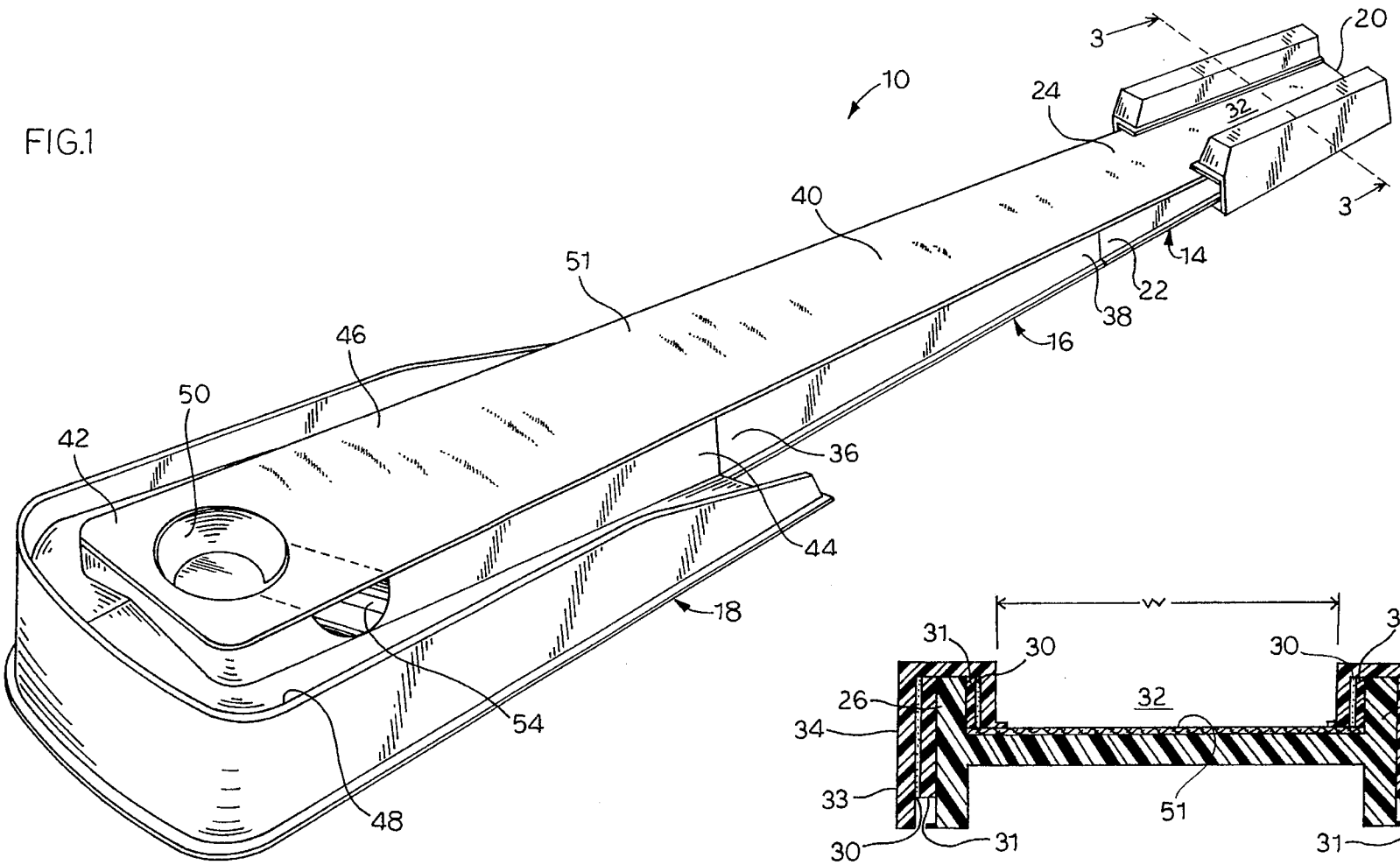
FIG. 1 is a perspective view of the preferred embodiment of the present invention golf putting practice system, showing a three piece construction of an elongated putting track.

Referring to FIG. 1, there is shown a perspective view of the preferred embodiment of the present invention golf putting practice system. The putting system is a complete golf training system which comprises an elongated putting track 10 for putting the golf ball on a real simulated golf course turf and a deterrent training device 12 (see FIG. 4) for providing a line of sight for the user. The putting track 10 is constructed from three pieces: the three piece design comprises a front uphill ramp 14, a middle uphill ramp 16 and a rear uphill ramp 18.

Figure 3:
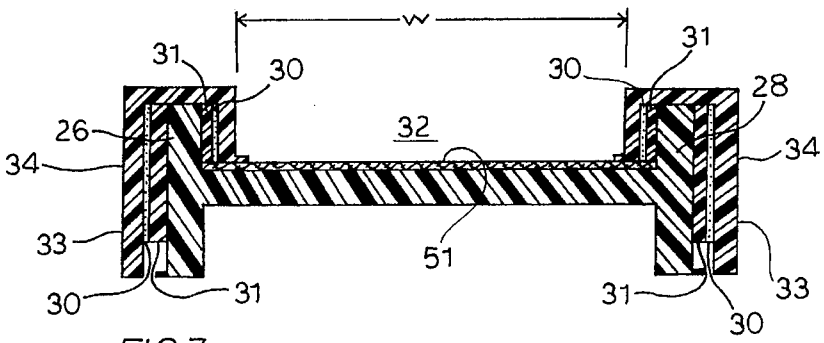
FIG. 3 is an enlarged cross-sectional view taken along line 3—3 of FIG. 1.

Referring to FIGS. 1 and 3, there is shown the front uphill ramp 14 which comprises a distal end 20, a proximal end 22, an inclined upper surface 24 decreasing in height from the proximal end 22 to the distal end 20, and two opposite parallel rails or sidewalls 26 and 28. The two opposite rails 26 and 28 are integrally connected to the inclined upper surface 24 and located adjacent to the distal end 20. The two rails 26 and 28 form a channel or space 32 therebetween for accommodating a head portion of a conventional golf putter (see FIGS. 4 and 5), where the golfer practices his or her putting stroke. The two rails 26 and 28 are provided to teach the golfer to swing correctly in a straight line while improving the touch of an individual. When the golfer swings incorrectly, the head portion of the putter strikes either one of the two rails 26 and 28, thereby causing an auditory and/or sensory impact to emphasize the mistake in the stroke. This will serve as a hindering reminder that the putting stroke is not straight, thereby informing the golfer that his or her putting stroke is not straight. If the golfer can swing the head portion of the golf putter between the two rails 26 and 28, and without making contact, he or she has made a correct putting stroke.

Referring to FIG. 3, there is shown an enlarged cross-sectional view showing a width W of the channel 32. The width W of the channel 32 may be increased or decreased so that the difficulty of the putting stroke is changed. The difficulty of the putting stroke is changed by removable covering training curbs 34. These training curbs 34 may be identical in construction so that they can be interchangeably covered to either one of the two opposite rails 26 and 28. The training curbs 34 can be adjusted to increase or decrease the width W of the channel 32 by shims 31 which are attached on both sides of the rails 26 and 28 as shown or on only the inside of the rails 26 and 28. The shims 31 are held in position by fasteners 30 such as VELCRO® (hook and loop) members or other suitable means. The shims 31 may be foam shims which are attached and utilized the same way as shims 31.

Figure 2:
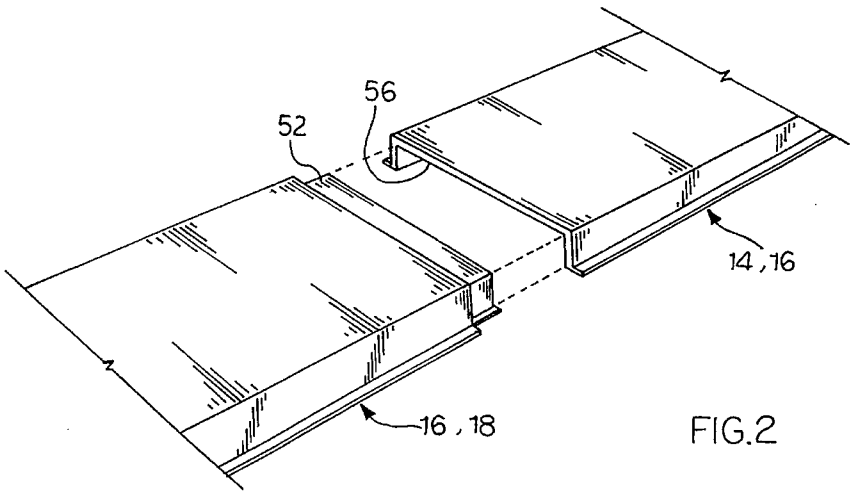
FIG. 2 is a partial exploded perspective view of the present invention golf putting practice system, showing how the plurality of ramps are attached to each other.

Referring to FIGS. 1 and 2, the middle uphill ramp 16 comprises two opposite proximal ends 36 and 38, and an inclined upper surface 40 decreasing in height from one proximal end 36 to the other proximal end 38. A protruding lower lip 52 (see FIG. 2) can be integrally connected to either one of the two proximal ends 36 and 38, preferably the lower lip is integrally connected to the proximal end 38.

It will be appreciated that the putting track 10 is not limited to one middle uphill ramp 16 as illustrated in FIG. 1. It is emphasized that while only one middle uphill ramp 16 is needed for this embodiment, it is also within the spirit and scope of the present invention to have a multiplicity of middle uphill ramps incorporated into the putting track 10 to vary the putting lengths.

The rear uphill ramp 18 comprises a distal end 42, a proximal end 44, an inclined upper surface 46 decreasing in height from the distal end 42 to the proximal end 44, a gutter 48, and a cup hole 50. The gutter 48 is integrally connected and surrounds the rear uphill ramp 18 along its circumference except for the proximal end 44. The cup hole 50 is integrally formed on the inclined upper surface 46 and located adjacent to the distal end 42. The cup hole 50 communicates with the gutter 48 via a side exit passage 54 to allow the golf ball to roll out from the cup hole 50 and into the gutter 48 such that the golf ball can be automatically returned to the golfer. The diameter of the cup hole 50 may be approximately 4¼ inches.

The length of the elongated putting track 10 may be nine (9) feet long. The length and width of each of the uphill ramps 14, 16 and 18 may be approximately 36 inches by 6 inches respectively. It will be appreciated that the dimensions described above are merely one illustrative embodiment and the present invention can include many other comparable sets of dimensions.

Referring to FIG. 2, there is depicted a partial exploded perspective view of how the uphill ramps 14, 16 and 18 are attached to each other. The middle and rear uphill ramps 16 and 18 each has a protruding lower lip 52, where each protruding lower lip 52 is integrally connected to the proximal ends 38 and 44 of the middle and rear uphill ramps 16 and 18 respectively. The protruding lower lips 52 will be lower than the upper surfaces 24, 40 and 46 of the front, middle and rear uphill ramps 14, 16 and 18 respectively. A lower surface 56 on each one of the front and middle uphill ramps 14 and 16 is placed on top of the protruding lower lip 52 such that the inclined upper surfaces 24, 40 and 46 of the front, middle and rear uphill ramps 14, 16 and 18 respectively are flush and symmetrical, thereby forming the elongated putting track 10. The inclined upper surfaces 24, 40 and 46 of the front, middle and rear uphill ramps 14, 16 and 18 respectively are covered by an elongated artificial turf 51 so that the elongated putting track 10 may simulate a real golf course.

When the golfer putts the golf ball into the cup hole 50, and thereby the golf ball rolls out from the side exit passage 54 and into the gutter 48, the gutter 48 has an inclined surface for automatically returning the golf ball to the golfer. When the golf ball misses the cup hole, the golf ball will land into the gutter and will be gravitationally rolled downwardly through either side of the gutter 48.

The elongated putting track 10 can be made from several materials. The manufacturing process which could accommodate the construction of the present invention may be vacuum formed, injection molded, extrusion, thermoform, etc. or other molding process. By way of example, the elongated putting track 10 can be made of plastic material or any other suitable material.

Figure 4:
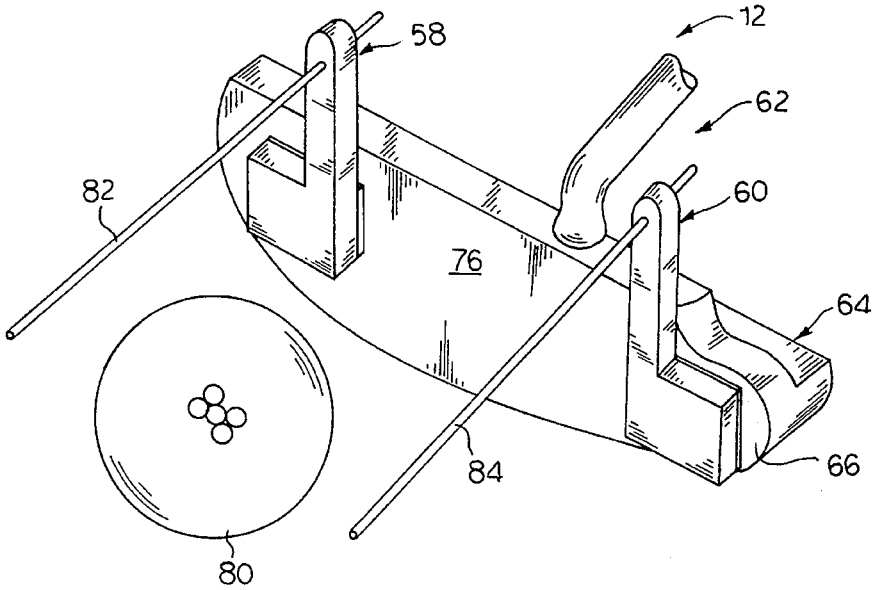
FIG. 4 is an enlarged perspective view of a conventional golf putter, showing attachment deflection members attached to the face of the putter and guide pointers extending away from the face and above the putter.
Figure 5:
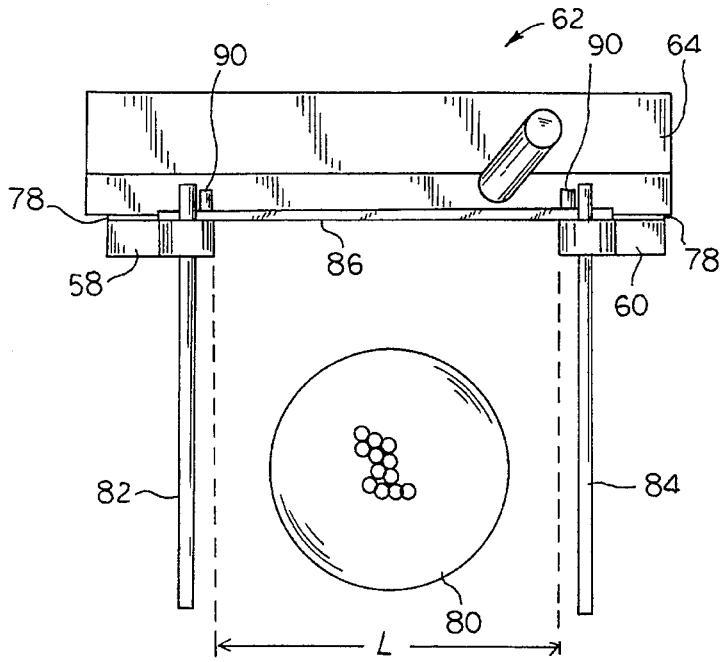
FIG. 5 is an enlarged top plan view of a conventional golf putter, showing attachment deflection members attached to the face of the putter and guide pointers extending away from the face of the putter.
Figure 6:
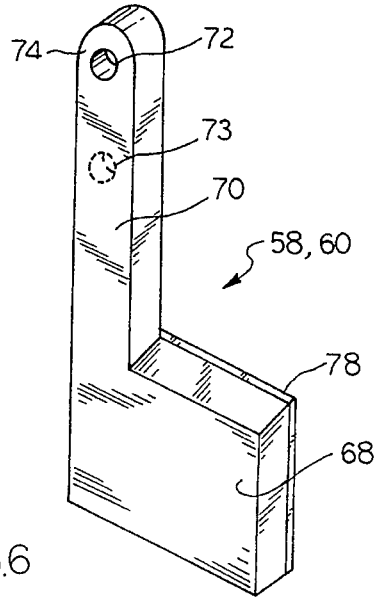
FIG. 6 is an enlarged perspective view of one of the two attachment deflection members without the guide pointer.

Referring to FIGS. 4, 5 and 6, there is shown at 12 the deterrent training device which is removably attachable to a conventional golf putter 62. The deterrent training device 12 comprises two attachment deflection members 58 and 60. Each of the attachment deflection members 58 and 60 is generally a L-shaped configuration and has a horizontal leg 68, a vertical leg 70 integrally connected to and upwardly extending from the horizontal leg 68, an aperture 72 therethrough and located at an upper portion 74 of the vertical leg 70, and a closed bottom aperture 73 (shown in dashed lines) located below the aperture 72. Both the attachment deflection members 58 and 60 are repositionably attachable to and form a sweet spot 76 therebetween on a face plate 66 of a head portion 64 of the putter 62 such that the distance between the two attachment deflection members 58 and 60 is greater than the diameter of a conventional golf ball 80. The two attachment deflection members 58 and 60 are attached to the face plate 66 by adhesive means, e.g., a double sided tape or adhesive putty 78 or other suitable means.

Two guide rod pointers 82 and 84 are each installed to a respective one of the apertures 72 of the two attachment deflection members 58 and 60, and extend forwardly away from the face plate 66 and above the head portion 64 of the putter 62. The guide rod pointers 82 and 84 are used for providing line of sight for the golfer.

Referring to FIGS. 4 and 5, the putter 84 is used to practice with the two attachment deflection members 58 and 60, and the two guide rod pointers 82 and 84 in place, such that the two attachment deflection members 58 and 60 provide guiding spacers for properly hitting the golf ball 80 on the sweet spot 76 of the putter 62. If the golf ball 80 is not stroked on the sweet spot 76, the golf ball 80 will be deflected by one of the two attachment deflection members 58 and 60. When the putter 62 is used for actual golf play, the two attachment deflection members 58 and 60 can be removed so that the same putter 62 can be used for both practice and actual play. Also, if the golfer's wrists are rotated during the stroke, the guide rod pointers 82 and 84 on the putter 62 will clearly represent to the golfer the rotational error during the stroke, and thereby the guide pointers 82 and 84 will magnify the error during the stroke and make it more clear to the golfer.

One of the unique features of the deterrent training device 12 is that the two attachment deflection members 58 and 60 are repositionable. The sweet spot 76 can be increased or decreased by repositioning the two attachment deflection members 58 and 60, and affixing them at different locations, so that the golfer can gradually work himself or herself up to a narrower sweet spot 76. The more improved the putting stroke is, the closer the two attachment deflection members 58 and 60 can be placed to each other.

Figure 6A:
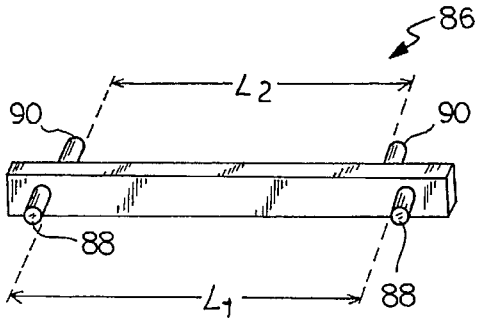
FIG. 6A is a perspective view of the rectangular shaped rod member.

Referring to FIG. 6A, there is shown at 86 a generally rectangular shaped rod member attachable to the two attachment deflection members 58 and 60 (see FIGS. 4 and 5). The rod member 86 comprises two pairs of pegs 88 and 90 which are integrally formed at opposite sides of the rod member as shown. The rod member 86 may or may not be used to assist the user to alter the distance "L" between the two attachment deflection members 58 and 60 (see FIG. 5). One of the two pairs of pegs 88 and 90 are respectively connected to the closed bottom apertures 73 of two attachment deflection members 58 and 60 as shown to change the distance "L" of the sweet spot 76. The distances $L_1$ and $L_2$ of two pairs of pegs 88 and 90 are approximately 1⅜ inches and 1 5/16 inches respectively. It will be appreciated that the dimensions described above are merely two illustrative embodiments and may include many other comparable sets of dimensions. It will also be appreciated that other suitable means may be used to attach the rod member 86 to the two attachment deflection members 58 and 60. By way of example, the rod member 86 may have a plurality of spaced apart holes therethrough, wherein detachable pegs are respectively inserted into one of the plurality of holes and into each hole 73 of the attachment deflection members 58 and 60.

Figure 7:
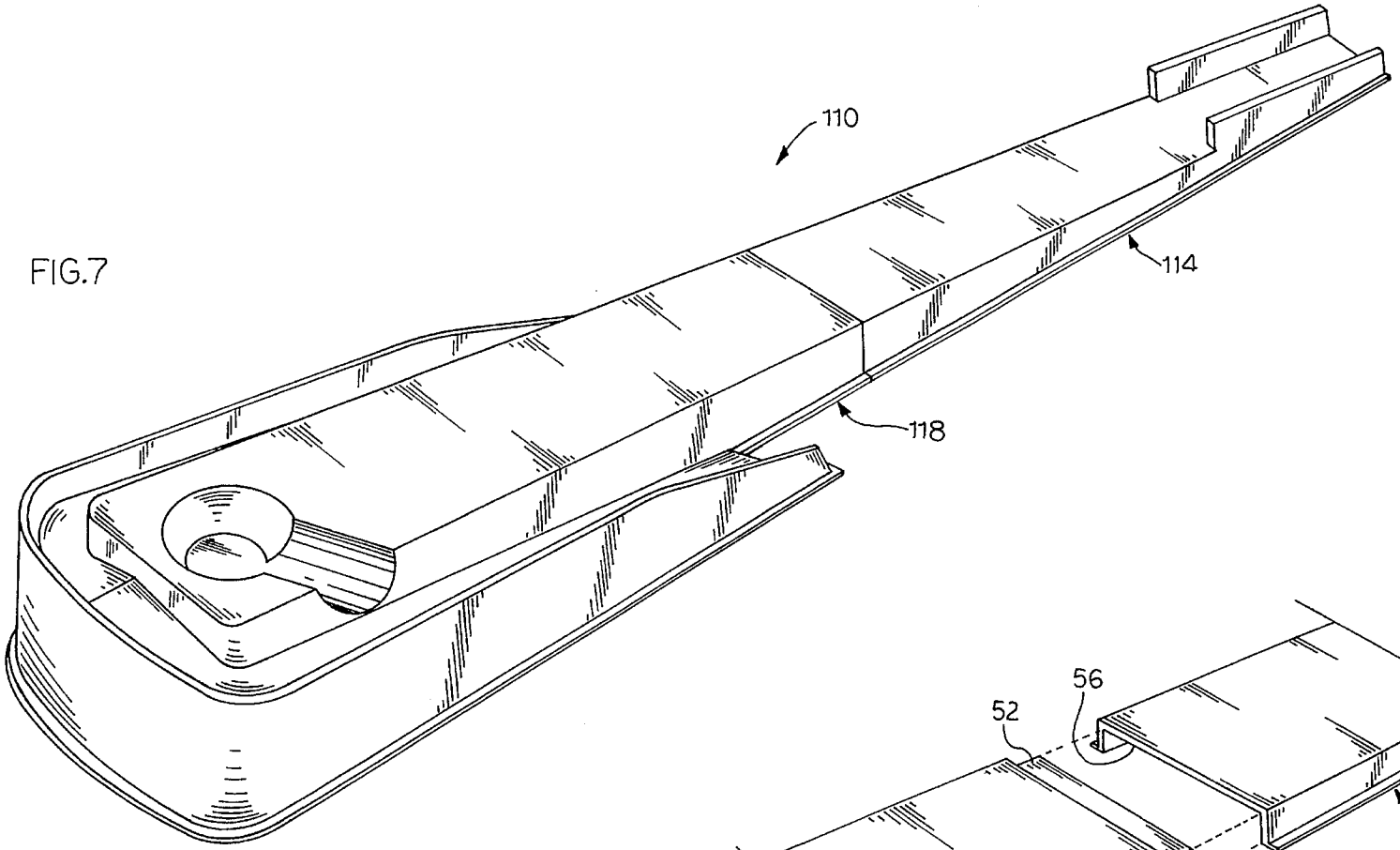
FIG. 7 is a perspective view of an alternative embodiment of the present invention golf putting practice system, showing a two piece construction of an elongated putting track.

Referring to FIG. 7, there is shown a perspective view of an alternative embodiment of the present invention golf putting practice system. The putting track 110 is constructed from two pieces: the two piece design comprises a front uphill ramp 114 and a rear uphill ramp 118. It functions and assembles the same as previously described above except that the middle uphill ramp 16 is eliminated from this embodiment. All other components are the same as previously described in FIGS. 1, 2 and 3, and the description thereof will not be repeated.

Figure 8:
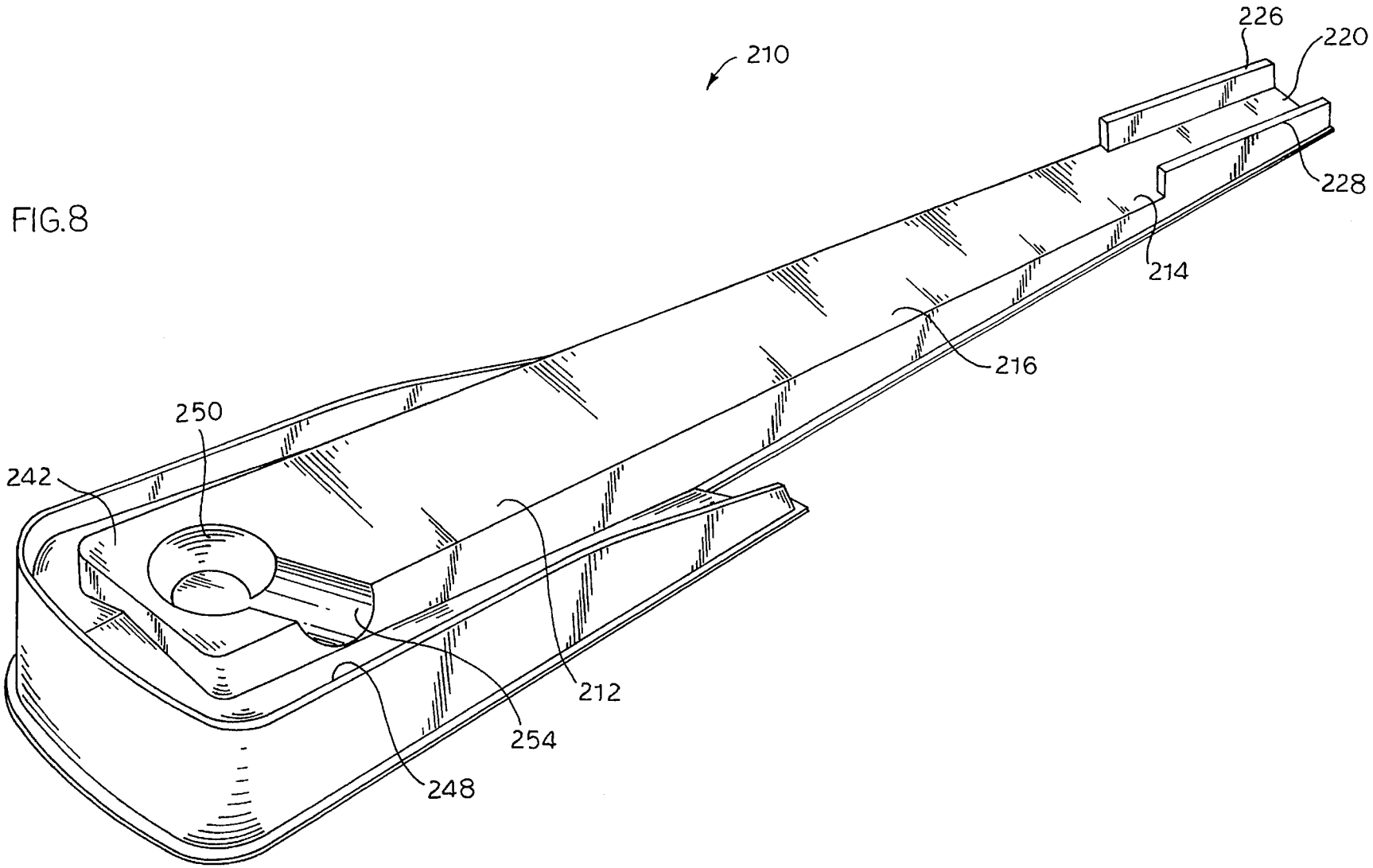
FIG. 8 is a perspective view of another alternative embodiment of the present invention golf putting practice system, showing an unitary construction of an elongated putting track.

Referring to FIG. 8, there is shown a perspective view of another alternative embodiment of the present invention golf putting practice system. It functions and assembles the same as previously described above except that the elongated putting track 210 is a unitary continuous uphill ramp. All other components are the same as previously described in FIGS. 1, 2 and 3, and the description thereof will not be repeated and only the modified components will be described in detail. In this embodiment, the components are numbered correspondingly with 200 added to each number.

The unitary continuous uphill track 210 comprises a distal portion 218 with a distal end 242, a middle portion 216 and a proximal portion 214 with a proximal end 220. A gutter 248 is integrally attached to and surrounds the distal portion 218 of the unitary continuous track 210 along its circumference. A cup hole 250 is integrally formed on the unitary continuous track 210 and is located adjacent to the distal end 242, where the cup hole 250 communicates with the gutter 248 via a side exit passage 254 which allows the golf ball to roll out from the cup hole 250 and into the gutter 248 to automatically return the golf ball to the golfer. Two parallel rails 226 and 228 are integrally connected to the proximal portion 214 of the unitary continuous track 210 and located adjacent to the proximal end 220, where the two parallel rails 226 and 228 form a channel 232 therebetween for allowing the golfer to practice putting by practicing a putting stroke without hitting the two parallel rails 226 and 228. Training curbs such as those depicted in FIG. 2 can also be utilized with this embodiment.

Defined in detail, the present invention is a golf putting practice system, comprising: (a) an elongated track including a rear uphill ramp, a middle uphill ramp and a front uphill ramp; (b) the rear uphill ramp having a distal end, a proximal end and an inclined upper surface decreasing in elevation from the distal end to the proximal end; (c) a gutter integrally connected and surrounding a portion of the rear uphill ramp along its circumference but not along the proximal end; (d) a cup hole integrally formed on the inclined upper surface of the rear uphill ramp and located adjacent to the distal end, where the cup hole communicates with the gutter via a side exit passage to allow a golf ball to roll out from the cup hole and into the gutter such that the golf ball can be automatically returned to a golfer; (e) the middle uphill ramp having two opposite proximal ends and an inclined upper surface decreasing in elevation from one end of the two opposite proximal ends to the other; (f) the front uphill ramp having a distal end, a proximal end and an inclined upper surface decreasing in elevation from the proximal end to the distal end; (g) two opposite parallel rails integrally connected to the inclined upper surface of the front uphill ramp and located adjacent to the distal end, where the opposite rails form a channel therebetween for allowing the golfer to practice putting by practicing a putting stroke without hitting the two opposite rails; (h) means for adjusting a width of the channel of the front uphill ramp to increase or decrease the difficulty of the putting stroke; (i) the proximal end of the front uphill ramp attached to one of the two opposite proximal ends of the middle uphill ramp such that the inclined upper surfaces are aligned, and the other one of the two opposite proximal ends of the middle uphill ramp attached to the proximal end of the rear uphill ramp such that the inclined upper surfaces are aligned, where the elevation of the rear uphill ramp is greater than the elevation of the middle uphill ramp, and the elevation of the middle uphill ramp is greater than the elevation of the front uphill ramp; (j) a putter having a head portion with a face plate; (k) two L-shaped attachment members repositionably attached to and forming a sweet spot therebetween on the face plate of the head portion of the putter, each attachment member having a horizontal leg, a vertical leg integrally connected to and upwardly extending from the horizontal leg and an aperture therethrough located at an upper portion of the vertical leg; (l) two guide rod pointers each installed on a respective one of the apertures of the two L-shaped attachment members and extending away the face plate of the putter and above the head portion of the putter for providing line of sight for the golfer; and (m) means for removably attaching the two L-shaped attachment members to the face plate of the head portion of the putter which allow the L-shaped attachment members to be repositioned on the face plate of the head portion of the putter to increase or decrease a width of the sweet spot of the putter; (n) whereby when the elongated putting track is formed, the golfer can practice putting the golf ball along the elongated putting track such that when the golf ball is stroked into the cup hole, the golf ball exits out and automatically rolls back to the golfer via the gutter, and when the golf ball misses the cup hole, the golf ball goes into the gutter and will automatically roll back to the golfer.

Defined broadly, the present invention is a putting practice system, comprising: (a) a track including a rear ramp, a middle ramp and a front ramp, each ramp having a first end and a second end; (b) a gutter attached to and surrounding a portion of the rear ramp along its circumference but not along the second end; (c) a cup hole formed on the rear ramp and located adjacent to the first end, where the cup hole communicates with the gutter to allow a golf ball to roll out from the cup hole and into the gutter such that the golf ball can be automatically returned to a golfer; (d) two parallel rails formed on the front ramp and located adjacent to the second end, where the parallel rails form a space therebetween for allowing the golfer to practice by practicing a putting stroke without hitting the two parallel rails; (e) the first end of the front ramp attached to the second end of the middle ramp such that the middle ramp is aligned with the front ramp, and the first end of the middle ramp attached to the second end of the rear ramp such that the rear ramp is aligned with the middle ramp; (f) a putter having a head portion; (g) at least two attachment members repositionably attached to and forming a sweet spot therebetween on the head portion of the putter; and (h) at least two pointers each attached to a respective one of the at least two attachment members and extending away from the head portion of the putter for providing line of sight for the golfer; (i) whereby when the track is formed, the golfer can practice putting the golf ball along the track such that when the golf ball is stroked into the cup hole, the golf ball exits out and automatically rolls back to the golfer via the gutter, and when the golf ball misses the cup hole, the golf ball goes into the gutter and will automatically roll back to the golfer.

Defined alternatively in detail, the present invention is a golf putting practice system, comprising: (a) an elongated track including a rear uphill ramp, a middle uphill ramp and a front uphill ramp; (b) the rear uphill ramp having a distal end, a proximal end, an inclined upper surface decreasing in elevation from the distal end to the proximal end; (c) a gutter integrally connected and surrounding a portion of the rear uphill ramp along its circumference but not along the proximal end; (d) a cup hole integrally formed on the inclined upper surface and located adjacent to the distal end, where the cup hole communicates with the gutter via a side exit passage to allow a golf ball to roll out from the cup hole and into the gutter such that the golf ball can be automatically returned to a golfer; (e) the middle uphill ramp having a distal end, a proximal end and an inclined upper surface decreasing in elevation from the distal end to the proximal end; (f) the front uphill ramp having a distal end, a proximal end and an inclined upper surface decreasing in elevation from the proximal end to the distal end; (g) two opposite parallel rails integrally connected to the inclined upper surface of the front uphill ramp and located adjacent to the distal end, where the two opposite rails form a channel therebetween for allowing the golfer to practice putting by practicing a putting stroke without hitting the two opposite parallel rails; (h) means for adjusting a width of the channel of the front uphill ramp to increase or decrease the difficulty of the putting stroke; and (i) the proximal end of the front uphill ramp attached to one of the two opposite proximal ends of the middle uphill ramp, and the other one of the two opposite proximal ends of the middle uphill ramp attached to the proximal end of the rear uphill ramp, where the elevation of the rear uphill ramp is greater than the elevation of the middle uphill ramp and the elevation of the middle ramp is greater than the elevation of the front uphill ramp; (j) whereby when the elongated putting track is formed, the golfer can practice putting the golf ball along the elongated putting track such that when the golf ball is stroked into the cup hole, the golf ball exits out and automatically rolls back to the golfer via the gutter, and when the golf ball misses the cup hole, the golf ball goes into the gutter and will automatically roll back to the golfer.

Defined alternatively broadly, the present invention is a putting practice system, comprising: (a) a track including a rear ramp, a middle ramp and a front ramp, each ramp having a first end and a second end; (b) a gutter attached to and surrounding the rear ramp along its circumference except for the second end; (c) a cup hole formed on the rear ramp and located adjacent to the first end, where the cup hole communicates with the gutter to allow a golf ball to roll out from the cup hole and into the gutter such that the golf ball can be automatically returned to a golfer; (d) two parallel rails attached to the front ramp and located adjacent to the second end, where the two parallel rails form a space therebetween for allowing the golfer to practice putting by practicing a putting stroke without hitting the two parallel rails; and (e) the first end of the front ramp attached to the second end of the middle ramp such that the middle ramp is aligned with the front ramp, and the first end of the middle ramp attached to the second end of the rear ramp such that the rear ramp is aligned with the middle ramp; (f) whereby when the track is formed, the golfer can practice putting the golf ball along the track such that when the golf ball is stroked into the cup hole, the golf ball exits out and automatically rolls back to the golfer via the gutter, and when the golf ball misses the cup hole, the golf ball goes into the gutter and will automatically roll back to the golfer.

Defined alternatively more broadly, the present invention is a putting practice system, comprising: (a) a least two tracks each track having a distal end and a proximal end; (b) a gutter attached to and surrounding one of the at least two tracks along its circumferences except for the proximal end; (c) a cup hole formed on the one of the at least two tracks and located adjacent to the distal end, where the cup hole communicates with the gutter to allow a golf ball to roll out from the cup hole and into the gutter such that the golf ball can be automatically returned to a golfer; (d) two parallel rails attached to the other one of the at least two tracks and located adjacent to the distal end, where the two parallel tracks form a channel therebetween for allowing the golfer to practice putting by practicing a putting stroke without hitting the two parallel rails; and (e) the proximal ends of the at least two tracks attached together such that the at least two tracks are aligned with each other; (f) whereby when the at least two tracks are formed, the golfer can practice putting the golf ball along the at least two tracks such that when the golf ball is stroked into the cup hole, the golf ball exits out and automatically rolls back to the golfer via the gutter, and when the golf ball misses the cup hole, the golf ball goes into the gutter and will automatically roll back to the golfer.

Defined alternatively even more broadly, the present invention is a putting practice system, comprising: (a) at least one continuous track having a distal portion with a distal end and a proximal portion with a proximal end; (b) a gutter attached to and surrounding the distal portion of the at least one continuous track along its circumference; (c) a cup hole formed on the at least one continuous track and located adjacent to the distal end, where the cup hole communicates with the gutter which allows a golf ball to roll out from the cup hole and into the gutter to automatically return the golf ball to a golfer; and (d) at least two parallel rails attached to the proximal portion of the at least one continuous track and located adjacent to the proximal end, where the at least two parallel rails form a channel therebetween for allowing the golfer to practice putting by practicing a putting stroke without hitting the two parallel rails; (e) whereby the golfer can practice putting the golf ball along the at least one continuous track such that when the golf ball is stroked into the cup hole, the golf ball exits out and automatically rolls back to the golfer via the gutter, and when the golf ball misses the cup hole, the golf ball goes into the gutter and will automatically roll back to the golfer.

Further defined alternatively in detail, the present invention is in combination with a putter having a head portion with a face plate, an apparatus comprising: (a) at least two L-shaped attachment members attachable to and forming a sweet spot therebetween on the face plate of the head portion of the putter, each attachment member having a horizontal leg, a vertical leg integrally connected to and upwardly extending from the horizontal leg and an aperture therethrough located at an upper portion of the vertical leg; (b) at least two guide pointers each installed to a respective one of the apertures of the at least two L-shaped attachment members and extending away from the face plate of the putter and above the head portion of the putter for providing line of sight for the golfer; and (c) means for removably attaching the at least two L-shaped attachment members to the face plate of the head portion of the putter which allow the at least two L-shaped attachment members to be repositioned on the face plate of the putter to increase or decrease a width of the sweet spot; (d) whereby the at least two L-shaped attachment members provide guiding spacers for properly hitting a golf ball, and when the golf ball is not stroked correctly on the sweet spot when it is stroked, the golf ball will be deflected by the respective one of the at least two L-shaped attachment members, and thereby causing an error on hitting the golf ball, and when the golf ball is stroked correctly on the sweet spot, and thereby the golf ball strikes the sweet spot on the putter, the golf ball will not be deflected.

Further defined alternatively broadly, the present invention is in combination with a putter having a head portion, an apparatus comprising: (a) at least two attachment members attachable to and forming a space therebetween on the head portion of the putter; and (b) at least two pointers each attached to a respective one of the at least two attachment members for providing line of sight for the golfer; (c) whereby the at least two attachment members provide guiding spacers for properly hitting a golf ball, and when the golf ball is not stroked correctly on the space when it is stroked, the golf ball will be deflected by the respective one of the at least two attachment members, and thereby causing an error on hitting the golf ball, and when the golf ball is stroked correctly on the space, and thereby the golf ball strikes the space on the putter, the golf ball will not be deflected.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A golf putting practice system, comprising:

a. an elongated track including a rear uphill ramp, a middle uphill ramp and a front uphill ramp;

b. said rear uphill ramp having a distal end, a proximal end and an inclined upper surface decreasing in elevation from the distal end to the proximal end;

c. a gutter integrally connected and surrounding a portion of said rear uphill ramp along its circumference but not along said proximal end;

d. a cup hole integrally formed on said inclined upper surface of said rear uphill ramp and located adjacent to said distal end, where the cup hole communicates with said gutter via a side exit passage to allow a golf ball to roll out from the cup hole and into said gutter such that the golf ball can be automatically returned to a golfer;

e. said middle uphill ramp having two opposite proximal ends and an inclined upper surface decreasing in elevation from one end of the two opposite proximal ends to the other;

f. said front uphill ramp having a distal end, a proximal end and an inclined upper surface decreasing in elevation from the proximal end to the distal end;

g. two opposite parallel rails integrally connected to said inclined upper surface of said front uphill ramp and located adjacent to said distal end, where the opposite rails form a channel therebetween for allowing the golfer to practice putting by practicing a putting stroke without hitting the two opposite rails;

h. means for adjusting a width of said channel of said front uphill ramp to increase or decrease the difficulty of the putting stroke;

i. said proximal end of said front uphill ramp attached to one of said two opposite proximal ends of said middle uphill ramp such that said inclined upper surfaces are aligned, and the other one of said two opposite proximal ends of said middle uphill ramp attached to said proximal end of said rear uphill ramp such that said inclined upper surfaces are aligned, where the elevation of said rear uphill ramp is greater than the elevation of said middle uphill ramp, and the elevation of said middle uphill ramp is greater than the elevation of said front uphill ramp;

j. a putter having a head portion with a face plate;

k. two L-shaped attachment members repositionably attached to and forming a sweet spot therebetween on said face plate of said head portion of said putter, each attachment member having a horizontal leg, a vertical leg integrally connected to and upwardly extending from the horizontal leg and an aperture therethrough located at an upper portion of the vertical leg;

l. two guide rod pointers each installed on a respective one of said apertures of said two L-shaped attachment members and extending away said face plate of said putter and above said head portion of said putter for providing line of sight for the golfer; and m. means for removably attaching said two L-shaped attachment members to said face plate of said head portion of said putter which allow said L-shaped attachment members to be repositioned on said face plate of said head portion of said putter to increase or decrease a width of the sweet spot of the putter;

n. whereby when said elongated putting track is formed, the golfer can practice putting the golf ball along said elongated putting track such that when the golf ball is stroked into said cup hole, the golf ball exits out and automatically rolls back to the golfer via said gutter, and when the golf ball misses said cup hole, the golf ball goes into said gutter and will automatically roll back to the golfer.

2. The system in accordance with claim 1 further comprising an elongated artificial turf attachable to said inclined upper surfaces of said front, middle and rear uphill ramps.

3. The system in accordance with claim 1 wherein said means for adjusting the width of said channel are removable training curbs for covering said two opposite rails of said front uphill ramp respectively.

4. The system in accordance with claim 1 wherein said two L-shaped guide members are repositionably attached to said face plate of said head portion of said putter by double sided adhesive means.

5. A putting practice system, comprising:

a. a track including a rear ramp, a middle ramp and a front ramp, each ramp having a first end and a second end;

b. a gutter attached to and surrounding a portion of said rear ramp along its circumference but not along said second end;

c. a cup hole formed on said rear ramp and located adjacent to said first end, where the cup hole communicates with said gutter to allow a golf ball to roll out from the cup hole and into said gutter such that the golf ball can be automatically returned to a golfer;

d. two parallel rails formed on said front ramp and located adjacent to said second end, where the parallel rails form a space therebetween for allowing the golfer to practice by practicing a putting stroke without hitting the two parallel rails;

e. said first end of said front ramp attached to said second end of said middle ramp such that said middle ramp is aligned with said front ramp, and said first end of said middle ramp attached to said second end of said rear ramp such that said rear ramp is aligned with said middle ramp;

f. a putter having a head portion; at least two attachment members repositionably attached to and forming a sweet spot therebetween on said head portion of said putter; and h. at least two pointers each attached to a respective one of said at least two attachment members and extending away from said head portion of said putter for providing line of sight for the golfer;

i. whereby when said track is formed, the golfer can practice putting the golf ball along said track such that when the golf ball is stroked into said cup hole, the golf ball exits out and automatically rolls back to the golfer via said gutter, and when the golf ball misses said cup hole, the golf ball goes into said gutter and will automatically roll back to the golfer.

6. The system in accordance with claim 5 further comprising an artificial turf attachable to said front, middle and rear ramps.

7. The system in accordance with claim 5 further comprising means for removably attaching said at least two attachment members to said head portion of said putter which allow said at least two attachment members to be repositioned on said head portion of said putter.

8. The system in accordance with claim 7 wherein said means includes double sided adhesive.

9. The system in accordance with claim 5 further comprising means for adjusting a width of said space of said front ramp to increase or decrease the difficulty of the putting stroke.

10. The system in accordance with claim 9 wherein said means for adjusting the width of said space comprises removable training curbs for covering said two parallel rails of said front ramp respectively.

11. The system in accordance with claim 5 wherein said rear ramp has an inclined elevation greater than an inclined elevation of said middle ramp, and the inclined elevation of said middle ramp is greater than an inclined elevation of said front ramp.

12. A golf putting practice system, comprising:

a. an elongated track including a rear uphill ramp, a middle uphill ramp and a front uphill ramp;

b. said rear uphill ramp having a distal end, a proximal end, an inclined upper surface decreasing in elevation from the distal end to the proximal end;

c. a gutter integrally connected and surrounding a portion of said rear uphill ramp along its circumference but not along said proximal end;

d. a cup hole integrally formed on said inclined upper surface and located adjacent to said distal end, where the cup hole communicates with said gutter via a side exit passage to allow a golf ball to roll out from the cup hole and into said gutter such that the golf ball can be automatically returned to a golfer;

e. said middle uphill ramp having a distal end, a proximal end and inclined upper surface decreasing in elevation from the distal end to the proximal end;

f. said front uphill ramp having a distal end, a proximal end and an inclined upper surface decreasing in elevation from the proximal end to the distal end;

g. two opposite parallel rails integrally connected to said inclined upper surface of said front uphill ramp and located adjacent to said distal end, where the two opposite rails form a channel therebetween for allowing the golfer to practice putting by practicing a putting stroke without hitting the two opposite parallel rails;

h. means for adjusting a width of said channel of said front uphill ramp to increase or decrease the difficulty of the putting stroke; and i. said proximal end of said front uphill ramp attached to one of said two opposite proximal ends of said middle uphill ramp, and the other one of said two opposite proximal ends of said middle uphill ramp attached to said proximal end of said rear uphill ramp, where the elevation of said rear uphill ramp is greater than the elevation of said middle uphill ramp and the elevation of said middle ramp is greater than the elevation of said front uphill ramp;

j. whereby when said elongated putting track is formed, the golfer can practice putting the golf ball along said elongated putting track such that when the golf ball is stroked into said cup hole, the golf ball exits out and automatically rolls back to the golfer via said gutter, and when the golf ball misses said cup hole, the golf ball goes into said gutter and will automatically roll back to the golfer.

13. The system in accordance with claim 12 further comprising an elongated artificial turf attachable to said inclined upper surfaces of said front, middle and rear uphill ramps.

14. The system in accordance with claim 12 wherein said means for adjusting the width of said channel comprises removable training curbs for covering said two opposite rails of said front uphill ramp respectively.

15. In combination with a putter having a head portion with a face plate, an apparatus comprising:

a. at least two L-shaped attachment members attachable to and forming a sweet spot therebetween on the face plate of the head portion of the putter, each attachment member having a horizontal leg, a vertical leg integrally connected to and upwardly extending from the horizontal leg and an aperture therethrough located at an upper portion of the vertical leg;

b. at least two guide pointers each installed to a respective one of said apertures of said at least two L-shaped attachment members and extending away from the face plate of the putter and above the head portion of the putter for providing line of sight for the golfer; and c. means for removably attaching said at least two L-shaped attachment members to the face plate of the head portion of the putter which allow said at least two L-shaped attachment members to be repositioned on the face plate of the putter to increase or decrease a width of said sweet spot;

d. whereby said at least two L-shaped attachment members provide guiding spacers for properly hitting a golf ball, and when the golf ball is not stroked correctly on said sweet spot when it is stroked, the golf ball will be deflected by said respective one of said at least two L-shaped attachment members, and thereby causing an error on hitting the golf ball, and when the golf ball is stroked correctly on said sweet spot, and thereby the golf ball strikes said sweet spot on the putter, the golf ball will not be deflected.

16. The apparatus in accordance with claim 15 wherein said means for removably attaching said at least two L-shaped attachment members to the face plate of the head portion of the putter includes double sided adhesive means.

17. The apparatus in accordance with claim 15 further comprising a rod member having two pairs of pegs on opposite sides of the rod member, one of the two pairs of pegs attachable to said at least two L-shaped attachment members respectively to form a particular distance for said sweet spot.

18. The apparatus in accordance with claim 17 wherein said particular distance is approximately 1⅜ inches.

19. The apparatus in accordance with claim 18 wherein said means for removably attaching said at least two attachment members to the head portion of the putter comprises double sided adhesive means.

20. The apparatus in accordance with claim 17 wherein said particular distance is approximately 1 5/16 inches.

21. The apparatus in accordance with claim 15 further comprising means for adjusting the space between said at least two attachment members.

22. The apparatus in accordance with claim 21 wherein said means for adjusting comprises a rod member having at least one pair of pegs attachable to said at least two attachment members respectively to form a particular distance for said space between said at least two attachment members.

23. The apparatus in accordance with claim 22 wherein said particular distance is approximately 1⅜ inches.

24. The apparatus in accordance with claim 22 wherein said particular distance is approximately 1 5/16 inches.

* * * * *